US005222313A

United States Patent [19]

Dowdy et al.

[11] Patent Number: 5,222,313

[45] Date of Patent: Jun. 29, 1993

[54] SLIPPER AND METHOD FOR APPLICATION AND REMOVAL OF WATER SPORTS APPAREL

[76] Inventors: Steven F. Dowdy, Twenty-Seven Pondview Rd., Arlington, Mass. 02174; Kenneth Cowan, 35 Vista Del Golfo, Long Beach, Calif. 90803

[21] Appl. No.: 696,630

[22] Filed: May 7, 1991

[51] Int. Cl.[5] ..... A43B 11/00

[52] U.S. Cl. ..... 36/138; 36/8.1

[58] Field of Search ..... 12/142 R, 142 P; 36/8.1, 9 R, 138; 2/67, 2.1 R

[56] References Cited

U.S. PATENT DOCUMENTS

| | | | |
|---|---|---|---|
| 1,617,462 | 2/1927 | Schamberg | 36/8.1 |
| 2,041,505 | 5/1936 | Woerle | 36/8.1 X |
| 2,721,811 | 10/1955 | Dacey et al. | 117/65 |
| 3,280,485 | 10/1966 | Arnold | 36/138 X |
| 3,675,244 | 7/1972 | Mayo et al. | 2/2.1 R |
| 3,953,566 | 4/1976 | Gore . | |
| 4,194,041 | 3/1980 | Gore et al. . | |
| 4,204,345 | 5/1980 | Bradley . | |
| 4,276,341 | 6/1981 | Tanaka | 2/2.1 R X |
| 4,294,022 | 10/1981 | Stockli et al. . | |
| 4,483,019 | 11/1984 | Spangrud et al. | 2/2.1 R |
| 4,616,428 | 10/1986 | Leger . | |
| 4,649,656 | 3/1987 | Cox et al. . | |
| 4,809,447 | 3/1989 | Pacanowsky et al. . | |
| 4,862,517 | 9/1989 | Meistrell | 2/2.1 R |
| 4,896,438 | 1/1990 | DeBease . | |
| 4,907,295 | 3/1990 | Yasuda | 2/2.1 R |

OTHER PUBLICATIONS

Skin Diver: May, 1990; cover page, p. 53 and p. 18.

*Primary Examiner*—Steven N. Meyers
*Assistant Examiner*—Ted Kavanaugh
*Attorney, Agent, or Firm*—Peter F. Corless; Ernest V. Linek

[57] ABSTRACT

Slipper type article and method for the application and removal of water sports apparel such as wet suits, dry suits and wet suit booties. The slipper is composed of a hydrophobic material such as ripstop nylon. The slipper aids the entry and withdrawal of a foot through the narrow leg openings of wet suits, dry suits and wet suit booties.

19 Claims, 1 Drawing Sheet

SLIPPER AND METHOD FOR APPLICATION AND REMOVAL OF WATER SPORTS APPAREL

FIELD OF THE INVENTION

The present invention relates to a slipper type article and method for the application and removal of water sports apparel such as wet suits, dry suits and wet suit booties.

BACKGROUND OF THE INVENTION

Wet suits worn by water sports enthusiasts such as skin and scuba divers, surfers, sailboarders and the like are typically contructed of a tight-fitting cellular elastomeric material. This construction permits water to enter through neck, ankle and arm openings of the suit where it flows into the suit's sponge-like elastomeric material and forms a thin water layer between the suit and the body of the suit's wearer. Because of the suit's tight fit, water that enters the suit is essentially non-circulating, and consequently is heated by the body of the wearer to provide an effective means of thermal insulation. The suit's tight fit is essential to its thermal insulating properties, such properties being compromised by any significant water circulation through the suit.

The requisite tight fit construction of the suit, however, makes it difficult and often quite time consuming for a wearer to either don or remove the suit. It can be particularly trying to insert and remove feet through the narrow leg openings of a wet suit. As may be evident, the leg openings must be sufficiently narrow to provide a tight fit around an ankle to inhibit water circulation into and through the suit. Such a narrow opening does not provide for easy insertion and withdrawal of the comparatively larger foot. Moreover, it has been found that when a person's bare foot, the wet suit, or both, are wet the surface resistance between the foot and the elastomeric material is notably increased. This makes the donning and removal of the suit even more difficult. During use, either the suit or the wearer's foot often will be wet during application of the suit, and water will virtually always be present during the suit's removal.

Additionally, over time the repeated pulling and stretching that are required to insert a foot through the leg openings can result in tearing or other deformation of the suit. This, in turn, leads to increased water circulation into and through the suit, decreasing the suit's insulating capabilities.

One approach to overcome this inherent problem of wet suits has been to provide a zipper of several inches length extending upward from the suit's leg opening. The zipper is opened to facilitate insertion and withdrawal of a foot. Once the foot is through the leg opening, the zipper is closed to inhibit water circulation. Such zipper systems, however, have proven to be less than fully satisfactory. Wet suit zippers often rust as well as leak, thereby reducing the suit's thermal insulating properties by enabling water circulation into and through the suit.

Other water sports apparel pose similar problems. For example, wet suit booties are typically constructed of cellular elastomer and are tight fitting like wet suits. See, for example, the bootie described in U.S. Pat. No. 4,294,022, incorporated herein by reference. Thus, the application and removal of such booties can be difficult due to resistance of a bare foot against the material of contruction of the bootie, particularly when the bootie and/or foot is wet. As with a wet suit, the pulling and stretching of the bootie that accompanies each application and removal can result in deformation of the bootie, and thereby reduce the useful life of the article.

Dry suits are also typically constructed of a cellular elastomer and tight fitting like wet suits, but provide insulating properties solely through the suit itself, rather than by means of an interstitial water layer. Again, the tight fit of these suits makes application and removal difficult which can result in deformation of leg openings or otherwise compromise the integrity and performance of the suit.

SUMMARY OF THE INVENTION

The present invention provides a slipper type article comprised of a hydrophobic material and that has an open end for inserting the foot of a user of the slipper through. To further aid passage of a foot through a narrow leg opening of a wet suit, dry suit or wet suit bootie, the hydrophobic slipper material preferably is essentially nonstretchable during use. The slipper preferably is shaped to conform to the foot of the user, and preferably is tight fitting during use. The slipper is releasably secured to the foot of the user, for example, by suitably positioned releasable fasteners and/or an elastic band disposed around the upper portion of the slipper.

It has been found that by covering a foot with a slipper of the present invention, a foot can be readily and quickly inserted into a leg opening of a wet suit, dry suit or wet suit bootie without the pulling, streching or other manipulation that would otherwise be required to don these articles. More specifically, use of the slipper of the present invention virtually eliminates the substantial resistance experienced when inserting a bare foot through the narrow leg opening of a wet suit, dry suit or wet suit bootie. While not wishing to be bound by theory, it is believed this reduced resistance results from the contact of the hydrophobic material of the slipper with the relatively aqueous and hydrophilic environment of the suit or bootie.

The method of the invention in general comprises the steps of placing a slipper of the above described type on the foot of a user, and inserting and/or withdrawing the thus covered foot through the leg opening of a wet suit, dry suit or wet suit bootie.

The slipper of the invention may be worn during use of an aquatic suit, or taken off during the suit's use and then reapplied to a foot for removal of the suit. When employed for donning a wet suit bootie, the slipper is worn during use of the bootie and preferably is constructed of a water permeable material to provide for complete heating of the full volume of insulating water within the bootie.

As used herein the term "aquatic apparel article" refers to a wet suit, dry suit and/or wet suit bootie.

It is an object of the invention to provide a means to aid in the application and removal of an aquatic apparel article.

It is another object of the invention to provide a means to enhance the useful life of an aquatic apparel article.

BRIEF DESCRIPTION OF THE DRAWING

A more complete understanding of the invention may be provided by reference to the accompanying Drawing wherein.

DESCRIPTION OF THE PREFERRED EMBODIMENTS

Figure 1:
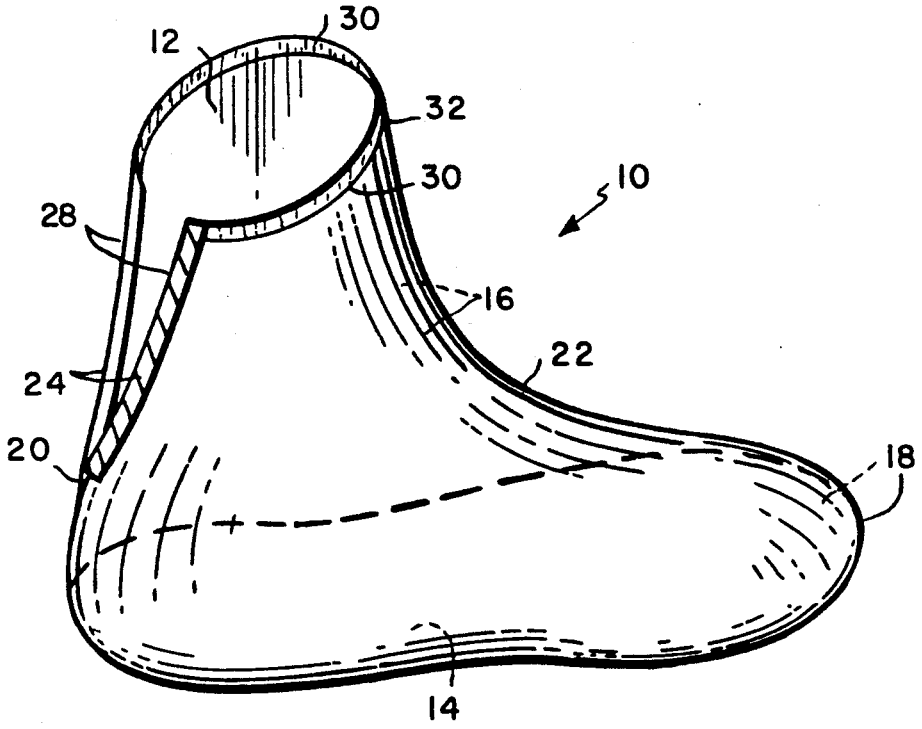
FIG. 1 is an above view of the slipper of the invention.
Figure 2:
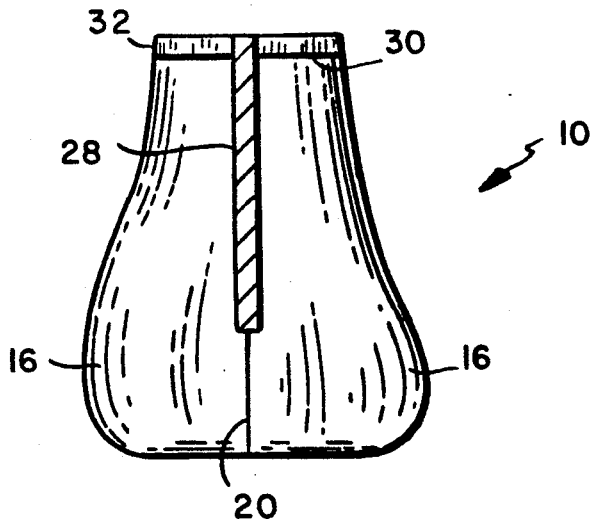
FIG. 2 is a rear view of the slipper of the invention where the slipper flap is closed.

The present invention as depicted in FIGS. 1-2 provides a slipper type article 10. Slipper 10 can be a variety of shapes and defines opening 12 through which the foot of a user of the slipper is inserted. Preferably, the slipper is of a shape that conforms well to the shape of the user's foot, and during use is tight fitting around the user's foot. It has been found that such a conformal and tight fitting slipper provides easier passage of a foot through an aquatic apparel article relative to a generally comparable, but looser fitting foot covering.

Slipper 10 can be composed of a single piece of material. Preferably, however, a multiple component construction is employed to provide a slipper that better conforms to the shape of a foot. Thus, a preferred construction provides a sole component 14 and one or more upper foot components 16. Foot component 16 is attached to the perimeter of sole component 14 by any suitable means, for example by sewing the materials together along seam 18. Greater than one component 16 may be employed. For example, as depicted in FIG. 1, a three piece configuration is suitable, where sole component 14 and two foot components 16 are attached by sewing along seams 18, 20 and 22. A multiple component slipper also readily enables fabrication of a slipper of a size and shape corresponding to a specific user's foot, thus providing a slipper that conforms particularly well to the shape of the user's foot.

Slipper 10 preferably covers at least the majority of the surface area of the user's foot. The slipper may further extend upward around the user's ankle. Such a design is shown in FIGS. 1-2 where the slipper extends upward, covering at least a portion of the user's ankle during use. A lower cut design is also suitable, i.e., where the slipper only covers the user's foot, and does not extend upward to the ankle.

Slipper 10 is constructed of a hydrophobic material that preferably is essentially nonstretchable during use of the slipper. Suitable hydrophobic, essentially nonstretchable materials include nylon, polyester, polyethylene, polypropylene, fabrics coated with hydrophobic films such as a polyurethane film, and other known hydrophobic materials. Ripstop nylon is a particularly preferred material for its strength at relatively low weights and thicknesses.

Slipper 10 can also be constructed of a hydrophobic material that is stretchable during use (e.g., lycra and other spandex materials), although stretchable materials are less preferred than essentially nonstretchable materials. During use a slipper constructed of a stretchable material can adhere to varying degrees to elastomeric cellular material. It has thus been found that a slipper constructed of an essentially nonstretchable material provides easier passage of a foot through an aquatic apparel article relative to a slipper fabricated from a stretchable material.

Additionally, the hydrophobic slipper material preferably is of a sufficient strength and thickness so that repeated use and wear of the slipper as contemplated herein does not compromise the slipper's integrity or performance. More specifically, after donning a wet suit or dry suit, a person wearing the slipper of the invention might frequently walk over sand and jagged rocks. Thus, the hydrophobic slipper material is preferably of a strength sufficient to avoid tearing or other destruction after repeated contact of the slipper with such abrasive surfaces.

When slipper 10 is used for application and removal of a wet suit bootie, the slipper preferably is constructed of a water permeable material to permit flow of water between a user's foot and the bootie. A suitable water permeable material is ripstop nylon. Flow of water through slipper 10 ensures the entire volume of insulating water within the bootie to be fully heated by foot of the wearer. If slipper 10 is constructed of a water impermeable material, heat transfer potentially may be incomplete to water on the side of the slipper distal to the user's foot, reducing the bootie's thermal insulating properties.

Slipper 10 is releasably secured to the foot of a user. For reasons noted above, the securing means preferably provides a tight fit of the slipper to a user's foot. A preferred securing means is shown in FIGS. 1-2. Slipper 10 has an open flap 24 extending downward from the top of the slipper. Flap 24 is comprised of two proximate, unattached sides of foot components 16. The length of flap 24 will vary with the particular design of the slipper. For example, for the slipper shown in FIGS. 1-2, flap 24 is suitably between about 2 to 3 inches in length. For a lower cut slipper, a shorter flap 24 would be employed. Flap 24 is held in a closed position by releasable fastening means 28, preferably matching hook and loop type fasteners 28 commonly identified under the trademark Velcro. The slipper is rendered tight fitting around the foot of a user by suitably fastening fasteners 28. The fasteners 28 can be sewn onto the two proximate sides of components 16. While in FIGS. 1 and 2 the fasteners 28 are depicted as aligned along the back of slipper 10, other designs are also suitable, for example longitudinally aligning the flap 24 (with fasteners 28 thereon) on either side of slipper 10 or in front of slipper 10. It should be appreciated that use of such a Velcro releasable seam provides a slipper that can be adjustably fastened to tightly fit a variety of sizes of feet.

Another suitable securing means provides disposing elastic band 30 on the vicinity of the slipper upper edge 32. The elastic band may affixed on the vicinity of edge 32 by number of means, for example by sewing the band thereon, or by an adhesive or heat bonding. Elastic band 30 is pulled to an expanded position to permit the insertion or withdrawal of a foot through slipper opening 12. In use, the elastic band draws tightly around the leg or ankle of a user to provide a tight fitting slipper.

As shown in FIGS. 1 and 2, releasable fasteners 28 and elastic band 30 may be employed in combination on the same slipper to ensure tight fit and security of the slipper on the user's foot.

The foregoing description of the present invention is merely illustrative thereof, and it is understood that variations and modifications can be effected without departing from the spirit or scope of the invention as set forth in the following claims.

What is claimed is:

1. A method for the application and removal of an aquatic apparel article, comprising:

placing on a person's foot a slipper member comprised of a hydrophobic material;

inserting the foot through a leg opening of an aquatic apparel article and then removing the slipper from the foot; and thereafter placing the slipper on the foot and then withdrawing the foot through the leg opening of the aquatic apparel article.

2. The method of claim 1 where the slipper comprises means for securing the slipper around the foot of a user and the slipper is secured around the foot after placing the slipper on the foot.

3. The method of claim 2 where the means for securing the slipper around the foot comprises releasable fasteners affixed to two proximate, unattached sides of the foot component, the fasteners positioned to overlap and releasably fasten each proximate side of the foot component.

4. The method of claim 3 where the releasable fasteners are mating hook and loop fasteners.

5. The method of claim 1 where the slipper comprises a sole component and at least one foot component, the foot component being attached to the perimeter of the sole component.

6. The method of claim 1 where the slipper is comprised of an essentially nonstretchable hydrophobic material.

7. The method of claim 6 where the essentially nonstretchable hydrophobic slipper material is selected from the group consisting of nylon, ripstop nylon, polyester, polyethylene, polypropylene, and fabrics coated with polyurethane films.

8. The method of claim 1 where the slipper is comprised of a stretchable material.

9. The method of claim 1 where the hydrophobic slipper material is of a sufficient strength whereby tearing of the slipper during use is inhibited.

10. A method for facilitating the application and removal of an aquatic apparel article, comprising:

placing on a person's foot a slipper member comprised of a hydrophobic material;

inserting the foot through a leg opening of an aquatic apparel article and then removing the slipper from the foot after inserting the foot through the leg opening; and placing the slipper on the foot prior to withdrawing the foot through the leg opening of the aquatic apparel article.

11. The method of claim 10 where the slipper is comprised of an essentially nonstretchable hydrophobic material.

12. The method of claim 11 where the hydrophobic, essentially nonstretchable slipper material is selected from the group consisting of nylon, ripstop nylon, polyester, polyethylene, polypropylene, and fabrics coated with polyurethane films.

13. The method of claim 10 where the slipper comprises means for securing the slipper around the foot of a user.

14. The method of claim 13 where the means for securing the slipper around the foot comprises releasable fasteners affixed to two proximate, unattached sides of the foot component, the fasteners positioned to overlap and releasably fasten each proximate side of the foot component.

15. The method of claim 14 where the releasable fasteners are mating hook and loop fasteners.

16. The method of claim 13 further comprising securing the slipper around the foot after placing the slipper on the foot.

17. The method of claim 10 where the aquatic apparel article is selected from the group consisting of a wet suit and a dry suit.

18. The method of claim 10 where the slipper is shaped to conform to the shape of the foot.

19. The method of claim 10 where the slipper comprises a sole component and at least one foot component, the foot component being attached to the perimeter of the sole component.

* * * * *